US006050037A

United States Patent [19]

Gifford

[11] Patent Number: 6,050,037

[45] Date of Patent: Apr. 18, 2000

[54] BRICK MOLDING HAVING AN INTEGRAL HINGE AND A CONCEALED MOUNTING SURFACE

[75] Inventor: Thomas E. Gifford, Elkhart, Ind.

[73] Assignee: Atlantis Plastics, Inc., Elkhart, Ind.

[21] Appl. No.: 09/010,426

[22] Filed: Jan. 21, 1998

Related U.S. Application Data

[60] Provisional application No. 60/035,409, Jan. 23, 1997.

[51] Int. Cl.[7] ..... E06B 1/28; E06B 1/60; E06B 3/96

[52] U.S. Cl. ..... 52/211; 52/288.1; 52/656.9; 52/717.01; 52/717.05; 52/730.4; 52/730.5

[58] Field of Search ..... 52/211, 212, 204.53, 52/204.54, 287.1, 730.4, 730.5, 732.2, 732.1, 734.1, 656.9, 717.01, 716.1, 717.05, 288.1, 730.3

[56] References Cited

U.S. PATENT DOCUMENTS

| | | | |
|---|---|---|---|
| 2,703,159 | 3/1955 | Van Fleet | 52/730.4 X |
| 2,880,049 | 3/1959 | Tarleton . | |
| 3,038,217 | 6/1962 | Harris . | |
| 3,321,223 | 5/1967 | Snow et al. | 52/656.9 X |
| 3,467,423 | 9/1969 | Schlegel, Jr. et al. | 52/717.05 X |
| 3,568,386 | 3/1971 | Gossen . | |
| 3,782,054 | 1/1974 | Goss | 52/656.9 X |
| 3,899,258 | 8/1975 | Matthews | 52/656.9 X |
| 3,949,526 | 4/1976 | Sherlock et al. | 52/656.9 X |
| 3,965,638 | 6/1976 | Newman | 52/616 |
| 4,204,376 | 5/1980 | Calvert | 52/309.1 |
| 4,240,765 | 12/1980 | Offerdinger | 52/656.8 X |
| 4,525,953 | 7/1985 | Stutzman . | |
| 4,640,049 | 2/1987 | Duncan . | |
| 4,903,449 | 2/1990 | Ellingson | 52/288.1 |
| 4,957,301 | 9/1990 | Clay, Jr. et al. . | |
| 5,001,877 | 3/1991 | Edwards | 52/288.1 |
| 5,560,175 | 10/1996 | Soyka, Jr. et al. | 52/716.5 |
| 5,638,643 | 6/1997 | Demartini et al. | 52/11 |
| 5,836,134 | 11/1998 | Couto et al. | 52/718.02 |

FOREIGN PATENT DOCUMENTS

| | | |
|---|---|---|
| 000419894 | 9/1990 | European Pat. Off. . |
| 002308775 | 4/1976 | France . |
| 2153890 | 2/1984 | United Kingdom . |

*Primary Examiner*—Robert Canfield
*Attorney, Agent, or Firm*—Baker & Daniels

[57] ABSTRACT

The present invention involves a molding for window and door frames. The molding includes molding extrusions disposed around the perimeter of the door or window frame. Each molding extrusion includes a base plate, cover, and hinge portion. The base portion is capable of mounting the molding extrusion on a frame member. The cover portion extends over and contacts the base portion. The hinge portion connects the base portion and the cover portion, and is flexible to allow the cover portion to pivot relative to the base portion. Each molding extrusion includes a mitered end, and the molding may include a brace having two legs, each leg engaging a mitered end. A lip formed on the base portion retains the brace. Both the brace and the base portion may have a mounting hole capable of receiving a fastener. The brace may also have upstanding side walls disposed adjacent to side walls of the base portions, which may additionally include lips retaining the brace on the base portion side walls. The base plate includes reinforcing ribs. The plastic material of the hinge portion has a higher durometer than the plastic material of said base portion and said cover portion, or may alternatively have a lesser thickness than the base and covers. The base plate includes an anchor channel, the cover portion includes an anchor lip, with the anchor channel being structured and arranged to receive and engage the anchor lip. The cover portion further includes a decorative surface.

9 Claims, 4 Drawing Sheets

BRICK MOLDING HAVING AN INTEGRAL HINGE AND A CONCEALED MOUNTING SURFACE

CROSS REFERENCE TO RELATED APPLICATIONS

This application claims the benefit under Title 35, U.S.C. § 119(e) of U.S. Provisional Patent Application Ser. No. 60/035,409, entitled BRICK MOLDING HAVING AN INTEGRAL HINGE AND A CONCEALED MOUNTING SURFACE, filed on Jan. 23, 1997.

BACKGROUND OF THE INVENTION

1. Field of the Invention

The present invention relates generally to an extruded hinged brick molding having an integral hinge and a concealed mounting surface for use as decorative trim around windows and doors in residential and/or commercial construction.

2. Background Art

Decorative brick moldings are well known in the art of residential and or commercial construction. Typically, brick moldings are installed around windows and/or doors in order to give the structure a pleasing, finished appearance by concealing the window mounting hardware and other unsightly irregularities where the exterior siding meets the frame of the window or door. Traditionally in the past, the carpenter or other craftsman constructed the entire window or door frame at the job site, and then trimmed out the windows and doors with brick molding after the windows, doors, and siding had been installed in order to conceal any mistakes or irregularities. As a result, each window frame on a structure was likely to be slightly different in size, and a custom built brick molding, typically made from wood, was thus necessary to in order to give the structure a uniform appearance.

Today, most carpenters and contractors have switched to pre-hung doors and premanufactured window assemblies that are constructed of wood, aluminum, polyvinyl or other materials which offer high durability in adverse weather conditions and a long service life. Polyvinyl materials do not need to be periodically painted or preserved, which greatly lowers maintenance costs, and modern Ultra-Violet inhibitors prevent UV breakdown of polyvinyl materials for many years. These pre-manufactured components are made with precise tolerances, are very uniform in size, and are much easier to trim around than were the old fashioned hand made window and door frames. Although the newer pre-manufactured components are built to rigid quality control standards and are very energy efficient, many homeowners have come to prefer the more substantial look provided by brick molding around the windows and doors. Also, buyers of manufactured housing tend to prefer the more traditional look provided by brick molding, which gives manufactured housing a more finished appearance. Accordingly, building contractors and manufacturers of manufactured housing have again begun to install brick molding around windows and doors. The modern brick moldings, like the windows and doors they surround, are generally constructed of long life, maintenance free polyvinyl rather than the more traditional wood.

In order for polyvinyl brick moldings to be cost competitive with wood and other traditional construction materials, and in order to match the appearance of wood and have the needed strength and stiffness properties, polyvinyl materials typically must be extruded as hollow tubular members. These modem polyvinyl brick moldings have a number of drawbacks. First, in many applications the mounting hardware such as nails, screws or other fasteners used to secure the brick molding to the structure are visible and cannot be countersunk and painted over as on wood moldings, which gives the window or door frame an unsightly and unfinished appearance. Some have attempted to solve this problem by using a two-piece molding in which a base is secured to the structure adjacent the window frame, and then a separate cover plate is secured to the base. Installers have a difficult time matching the miter cuts on the two piece units, and two piece units still have visible mounting hardware. Accordingly, there exists a need for a brick molding for use as trim around windows and doors that is durable and easy to install and that offers a clean, finished appearance.

SUMMARY OF THE INVENTION

The present brick molding has a concealed mounting surface that is covered by a hinged cover plate which completely conceals all of the mounting hardware. The cover plate is attached to the base plate by an integral hinge which is virtually invisible and indistinguishable from the rest of the molding. The surface of the integral hinge is continuous with the surface of the cover plate and the base plate, and thus there are no internal or external gaps or openings to trap and collect dirt or debris.

The brick molding according to the present invention is preferably extruded from polyvinyl in a single component using the dual durometer extrusion process commonly employed in the plastics industry. The dual durometer process uses a relatively stiff exterior grade polyvinylchloride plastic (PVC) for the base plate and the cover plate, and a more flexible 90 durometer PVC for the flexible hinge. The flexible hinge joins one end of the cover plate to one end of the base plate, and allows the cover plate to pivot away from the base plate so that the base plate can be secured to the structure using conventional mounting hardware. After the base plate is secured to the structure, the cover plate pivots into place over the base plate. The cover plate and the base plate snap together to secure the cover plate in place. When installed, the snap feature is effectively concealed by the window frame so that the brick molding has a uniform finished appearance uninterrupted by hinges or mounting hardware of any kind.

Accordingly, it is an object of this invention to provide a brick molding for use as trim around windows and doors that has a uniform finished appearance.

Another object of this invention is to provide a brick molding having an integral hinge that allows the cover plate pivot out of the way to provide access to the base plate.

Still another object of this invention is to provide a hinged brick molding having an integral hinge that is virtually undetectable to the eye and that offers a smooth uninterrupted surface.

These and other objects of the invention will become evident upon a reading of the following detailed description.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
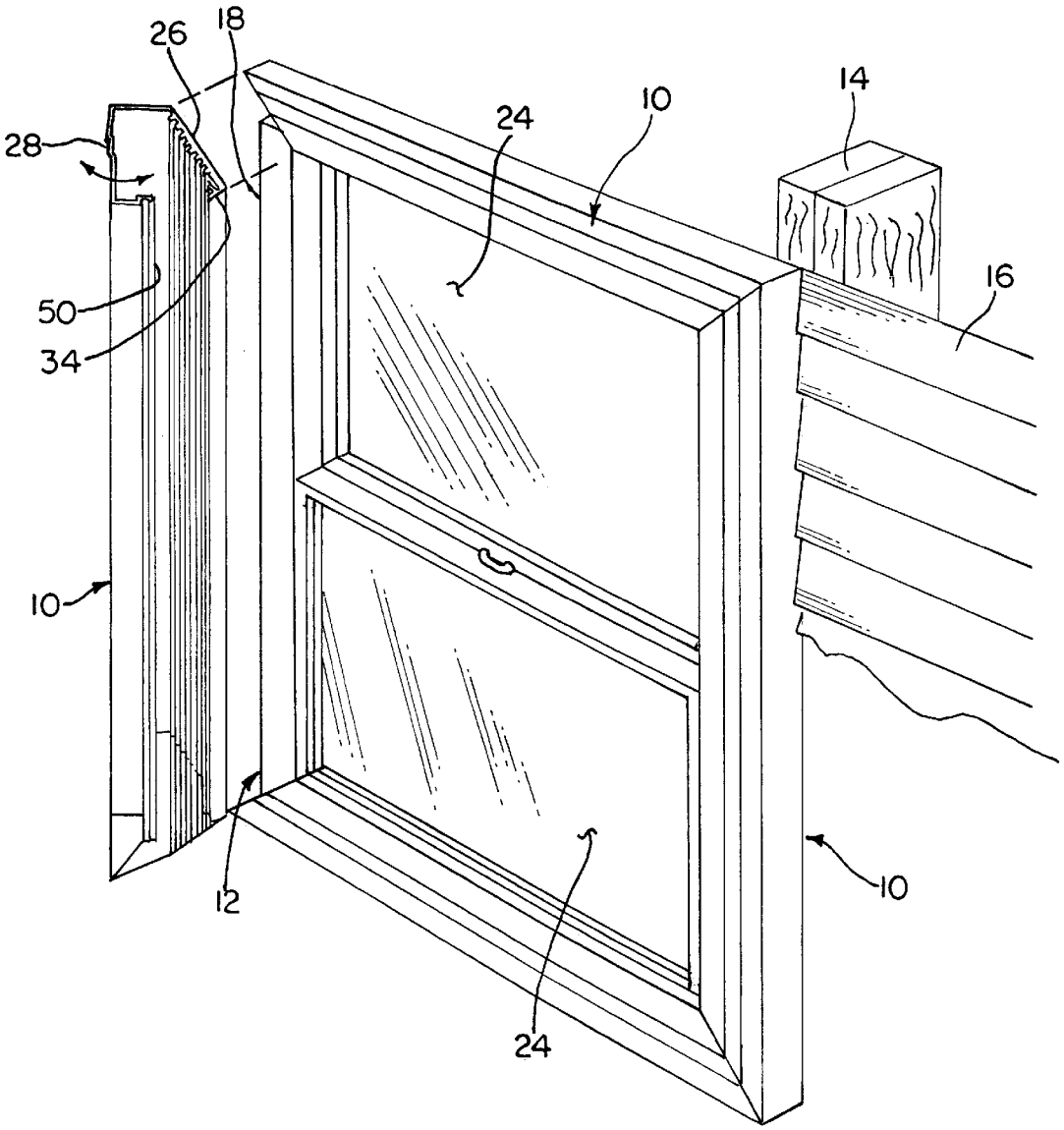
FIG. 1 is a partially exploded view in perspective of the brick molding according to the present invention shown with three pieces of molding installed and snapped in the closed position and a fourth piece ready to be installed.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, in several forms, and such exemplifications are not to be construed as limiting the scope of the invention in any manner.

DETAILED DESCRIPTION OF THE INVENTION

The embodiments herein described are not intended to be exhaustive or to limit the invention to the precise forms disclosed. Rather, they are chosen and described to explain the principles of the invention and its application and practical use to best enable others skilled in the art to follow their teachings.

Referring now to the drawings, a hinged brick molding according to the present invention is generally referred to by the reference numeral 10. As shown in FIG. 1, molding 10 is typically installed around the perimeter of a pre-manufactured window 12 which is secured to the frame 14 of structure 16 using commonly employed construction methods. Window 12 typically includes window frame 18 surrounding upper and lower sashes 20, 22, each of which has glass pane 24.

Figure 2:
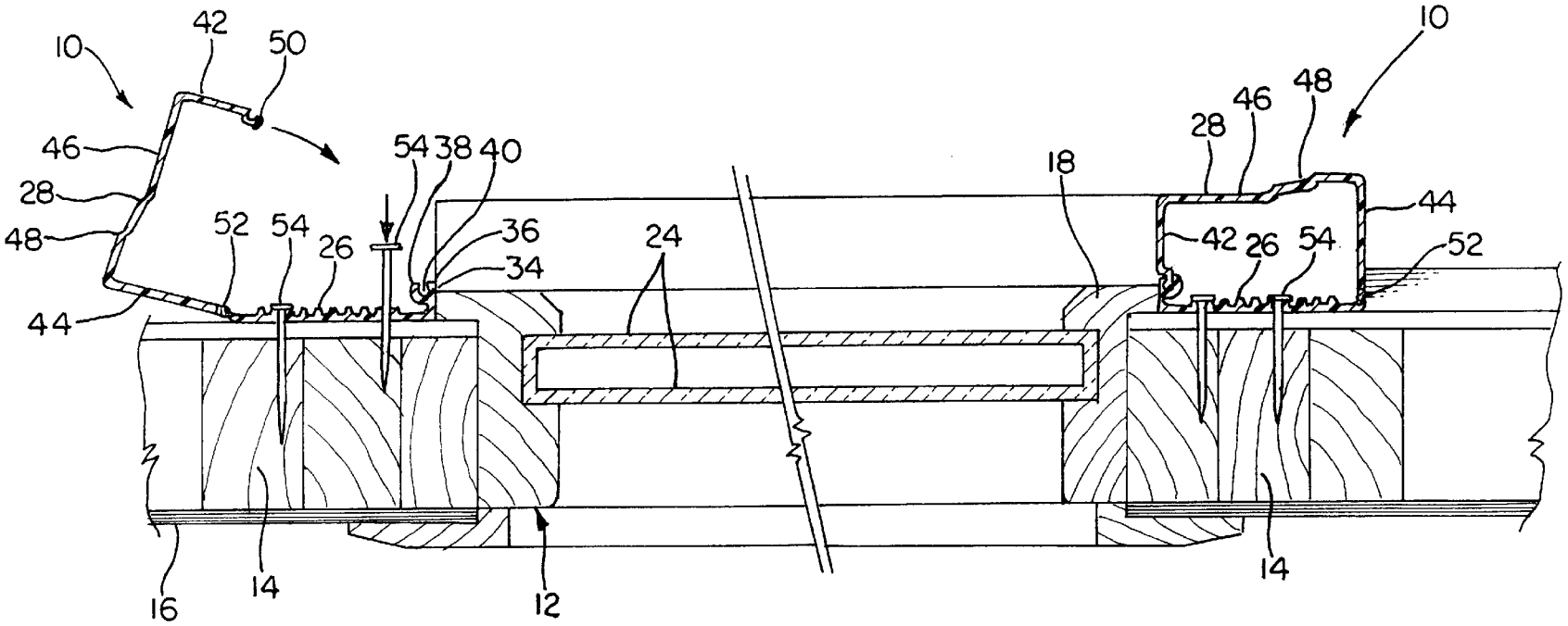
FIG. 2 is a fragmentary view in cross-section of the hinged brick molding of the present invention shown being installed around the perimeter of a window frame.
Figure 3:
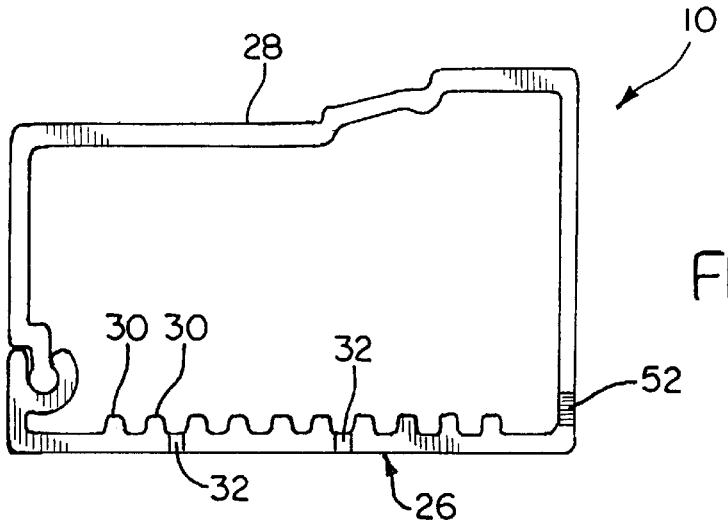
FIG. 3 is a cross-sectional view of the hinged brick molding shown with the cover plate secured to the base plate.
Figure 4:
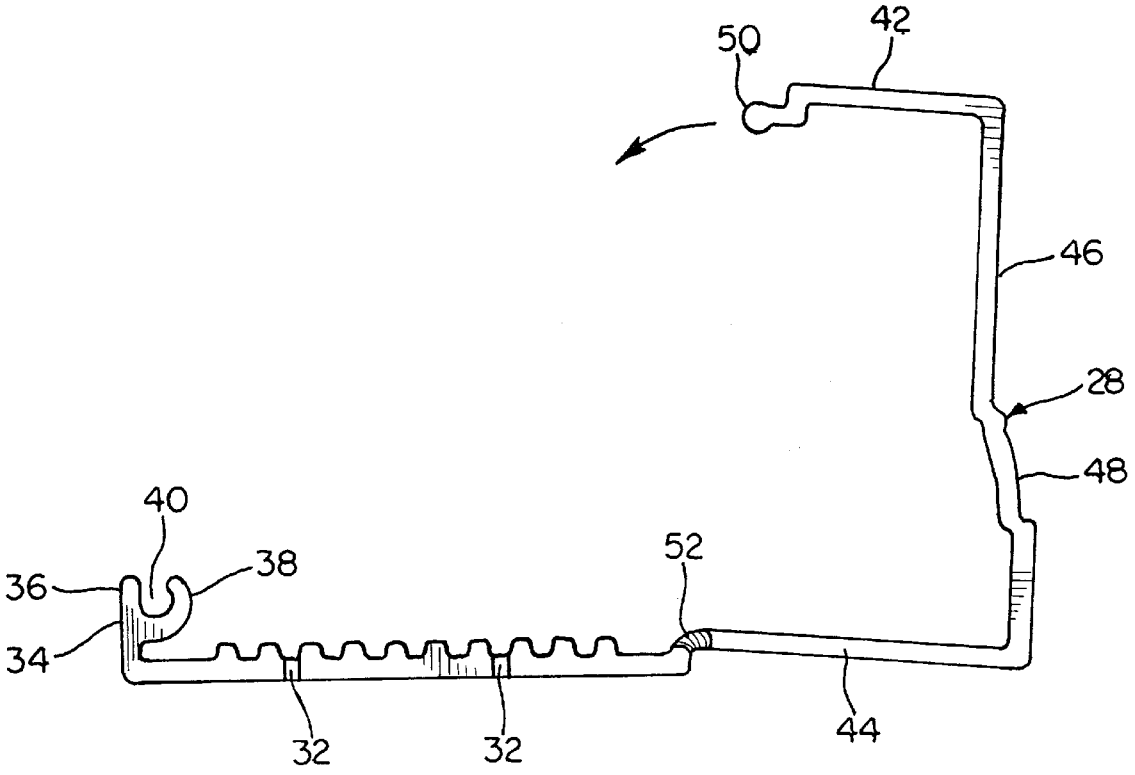
FIG. 4 is a cross-sectional view of the hinged brick molding similar to that shown in FIG. 3 but shown with the cover plate in the open position to provide access to the base plate.

Referring now to FIGS. 2, 3 and 4, molding 10 includes a base plate 26 and a cover plate 28. Base plate 26 and cover plate 28 are preferably constructed of rigid exterior grade PVC plastic, e.g., with a 70 or 80 durometer. Base plate 26 includes a plurality of reinforcing ribs 30 and a plurality of mounting holes 32 which are spaced at intervals along the longitudinal dimension of molding 10. Mounting holes 32 are typically drilled through base plate 26 after the section has been extruded. One end of base plate 26 includes an anchor structure 34 having a pair of upwardly extending side walls 36, 38 which define a restricted anchor receiving channel 40 therebetween as is discussed in greater detail below. Cover plate 28 includes a pair of side walls 42, 44 and an outer wall 46 having an optional decorative surface 48. The free end of side wall 42 terminates in an anchor lip 50 having a substantially circular cross section which snap fits into the channel 40 of anchor structure 34 such that protrusions 36, 38 releasably clamp the lip 50 therein as shown in FIG. 3. The corresponding end of side wall 44 is secured to base plate 26 by a flexible hinge 52, which permits cover plate 28 to pivot about hinge 52 between the open position shown in FIG. 4 and the closed position shown in FIG. 3. Flexible hinge 52 is preferably formed from flexible PVC 90 durometer plastic, and may have a different, lesser, thickness than the molding wall. Brick molding 10 is preferably manufactured using a dual durometer extrusion process as is typically employed in the plastics manufacturing industry. Alternatively, hinge 52 may be made of the same material as the side walls, but with a lesser thickness to provide greater flexibility.

In operation, brick molding 10 is extruded in a continuous section using the dual durometer extrusion process referred to above. Molding 10 is cut into standard length sections for shipping and handling, such as 8', 10', 12' or any other length as desired by the end user. Immediately prior to installation, each section of molding 10 is cut to the desired length and trimmed using a miter saw, which is typically set at 45 degrees, so that adjacent sections of brick molding 10 will fit tightly together as shown in FIG. 1. With the cover plate 28 in the open position shown in FIG. 4, base plate 26 is secured to frame 14 using a plurality of fasteners 54 such as nails, screws or other conventional fasteners inserted through mounting holes 32 as shown in FIG. 2. As shown at the right side of FIG. 2, after base plate 26 is secured to frame 14, cover plate 28 is pivoted about flexible hinge 52 until lip 50 snaps into channel 40 of anchor structure 34. With the cover plate 28 snapped in the closed position, the outward appearance of the molding 10 is substantially as shown in the finished portions of FIG. 1. In the closed position shown in FIGS. 2 and 3, anchor structure 34 and lip 50 are substantially concealed from exterior view by portions of window frame 18.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

Figure 5:
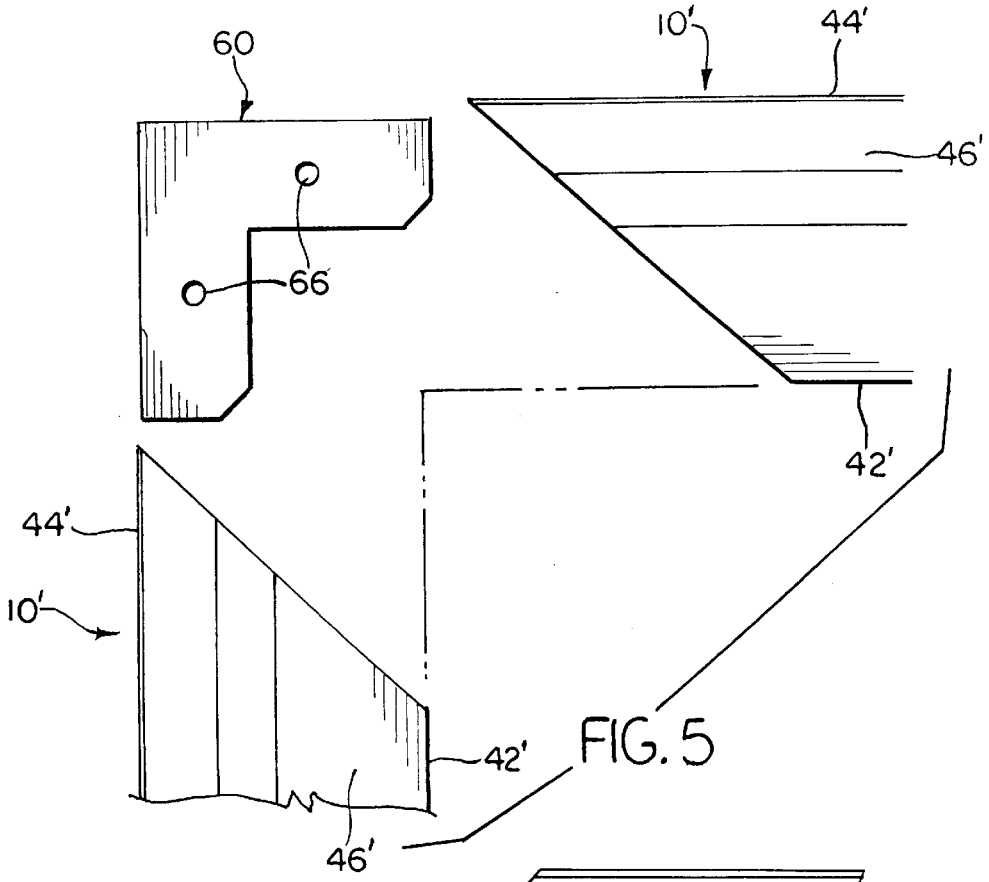
FIG. 5 is an exploded view of an alternative embodiment using a corner brace.
Figure 6:
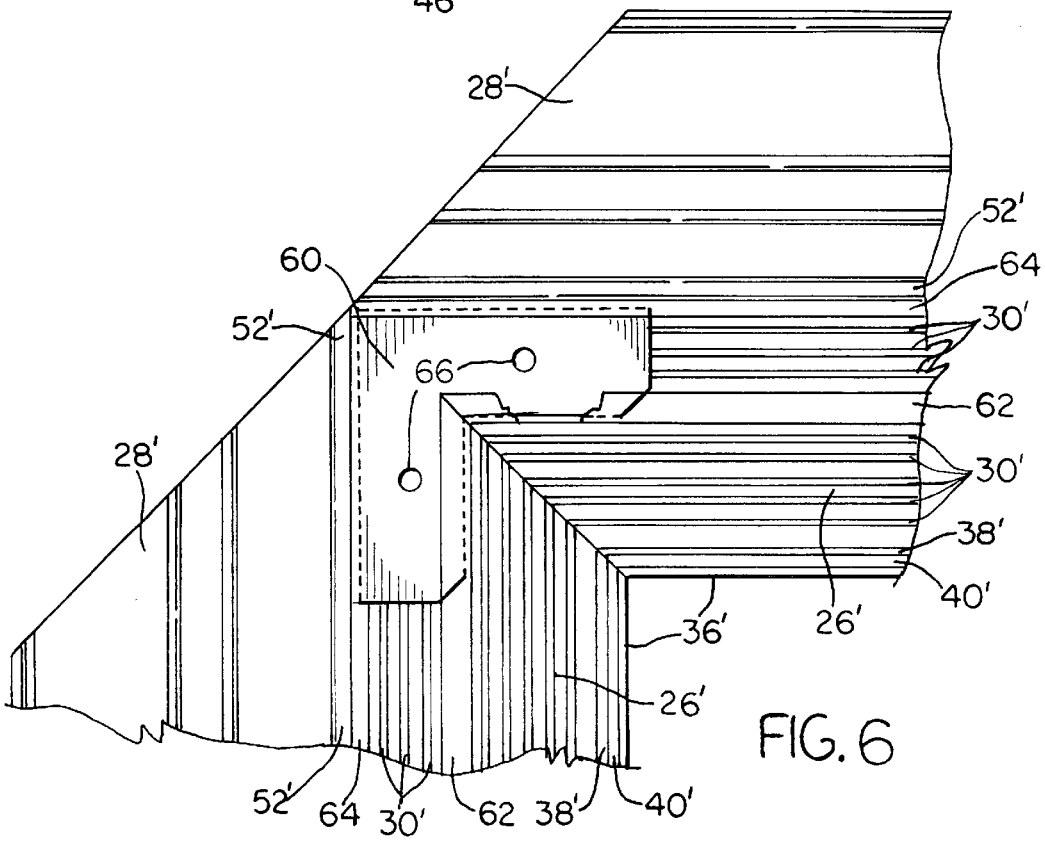
FIG. 6 is an assembled top plan view in partial cut-away of the embodiment of FIG. 5 with the cover plates open.

An alternative construction of the corner portions of the molding is shown in FIGS. 5 and 6. Brace 60, such as a piece of sheet metal in the form of a right angle formed by the two legs, is used to retain and hold mitered ends of the hinged brick molding. Minor modifications to the previously disclosed embodiment are disclosed below which allows the hinged brick molding construction to accommodate brace 60.

In this alternative embodiment, hinge 52' is located at the juncture of side walls 44' and 46', so that side wall 44' is fixedly attached to base plate 26'. Base plate 26' includes lip 62 which is disposed in parallel relation to reinforcing ribs 30' and extends over brace 60. Brace 60 may optionally include side walls which extend in parallel relation to side walls 44', and the upper portion of side walls 44' may then also include lip 64 to extend over the side walls of brace 60. Brace 60 slidingly engages rib 62 so that mitered ends of molding may be conveniently combined. Mounting holes 66 also allow for brace 60 to be engaged by nails or screws (not shown in FIGS. 5 or 6) during installation to secure together the corner joint.

I claim:

1. A molding for window and door frames comprising:

a plurality of molding extrusions disposed around the perimeter of a frame, each said molding extrusion including:

a base portion including a mounting hole adapted to accept a fastener therethrough for mounting said molding extrusion on a frame member, said base portion comprising an anchor channel which upstands from said base portion in a substantial perpendicular orientation, relative to said base portion;

a cover portion extending over and contacting said base portion, said cover portion comprising an anchor lip, interferingly receivable in said anchor channel; and a hinge portion connecting said base portion and said cover portion, said hinge portion being flexible allowing said cover portion to pivot relative to said base portion.

2. The molding of claim 1 wherein each one of said molding extrusions includes at least one mitered end.

3. The molding of claim 2 further comprising a brace having two legs, each leg engaging said mitered end of said molding extrusions.

4. The molding of claim 3 wherein said molding extrusions include a lip formed on said base portion, said lip retaining said brace on said base portion.

5. The molding of claim 3 wherein said brace includes a mounting hole capable of receiving a fastener.

6. The molding of claim 5 wherein said base portion includes side walls with lips for retaining said brace on said base portion side walls.

7. The molding of claim 1 wherein said base portion includes reinforcing ribs.

8. The molding of claim 1 wherein said base portion, said cover portion, and said hinge portion are made of a plastic material, and the plastic material of said hinge portion has a more flexible durometer than the plastic material of said base portion and said cover portion.

9. The molding of claim 1 wherein said hinge portion has a lesser thickness than said base portion and said cover portion.

* * * * *